US007506864B2

(12) United States Patent
Wakabayashi et al.

(10) Patent No.: US 7,506,864 B2
(45) Date of Patent: Mar. 24, 2009

(54) CUTTING DEVICE, FINISHER AND BOOKBINDING SYSTEM PROVIDED THEREWITH

(75) Inventors: Hiroyuki Wakabayashi, Hachioji (JP); Masaaki Uchiyama, Hachioji (JP); Tsuyoshi Shiokawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 216 days.

(21) Appl. No.: 11/706,293

(22) Filed: Feb. 15, 2007

(65) Prior Publication Data

US 2007/0267801 A1 Nov. 22, 2007

(30) Foreign Application Priority Data

May 18, 2006 (JP) ..... 2006-138695
Dec. 27, 2006 (JP) ..... 2006-351498

(51) Int. Cl.
*B26D 7/18* (2006.01)

(52) U.S. Cl. ..... 270/58.07; 270/21.1; 270/52.17

(58) Field of Classification Search ..... 270/21.1, 270/52.17, 58.07; 83/109, 111, 112
See application file for complete search history.

(56) References Cited

U.S. PATENT DOCUMENTS

2004/0096253 A1* 5/2004 Ueno et al. ..... 399/385

FOREIGN PATENT DOCUMENTS

| | | | |
|---|---|---|---|
| JP | 2005-040890 | | 2/2005 |
| JP | 2005-169598 | | 6/2005 |
| JP | 2005161411 A | * | 6/2005 |
| JP | 2005-271175 | | 10/2005 |
| JP | 2005-342854 | | 12/2005 |

* cited by examiner

*Primary Examiner*—Gene Crawford
*Assistant Examiner*—Leslie A Nicholson, III
(74) *Attorney, Agent, or Firm*—Finnegan, Henderson, Farabow, Garrett & Dunner, L.L.P.

(57) ABSTRACT

A cutting device that cuts an edge portion of a sheet bundle having plural sheets stacked, includes: a cutting blade; a paddle provided on a side of the cutting blade, which removes chips attached to the cutting blade by rubbing a side surface of the cutting blade; a controller which controls drive of the paddle. The controller includes a judging section which compares a length of the chips in a direction perpendicular to an edge side of the sheet bundle to be cut by the cutting blade with a predetermined length that has been preset. When the length of the chips is shorter than the predetermined length, the controller makes the paddle to rotate in a predetermined direction, and when the length of the chips is longer than the predetermined length, the controller makes the paddle to rotate in a reverse direction.

13 Claims, 10 Drawing Sheets

CUTTING DEVICE, FINISHER AND BOOKBINDING SYSTEM PROVIDED THEREWITH

This application is based on Japanese Patent Application Nos. 2006-138695 filed on May 18, 2006 and 2006-351498 filed on Dec. 27, 2006, which are hereby incorporated by reference.

BACKGROUND OF THE INVENTION

The present invention relates to a cutting device for cutting the edge portion of a sheet bundle in which a plurality of sheets are stacked on top of one another, a finisher for finishing the sheet ejected from the image forming apparatus, on which an image has been formed, thereby creating a sheet bundle and cutting the edge portion of the sheet bundle, and a bookbinding system equipped with an image forming apparatus and the aforementioned finisher.

Heretofore, there has been provided a finisher equipped with a cutting device, that receives sheets on which images have been formed by an image forming apparatus such as a photocopier and printer, and binds the sheets by performing the processes of center-binding and center-folding, and then cuts and trims the edge portion of the sheet bundle bound in the form of a book.

In the cutting device described in the Unexamined Japanese Patent Application Publication No. 2005-40890 (Claim 15, FIG. 15), a sheet bundle is held in vertically or obliquely by a holding and rotating section for holding the sheet bundle, and is cut by sliding a rotating circular cutting blade from the lateral or upper oblique direction with respect to the sheet bundle. Then chips produced by the process of cutting are dropped into a dust box by rotating a paddle arranged nearby.

In the cutting device described in the Unexamined Japanese Patent Application Publication No. 2005-169598 (Paragraph 0080, FIG. 11), the edge of a sheet bundle is cut by back-and-forth motion of a rotating cutting blade, and the cutting device is provided with a rotating paddle for removing the chips being cut by a cutting blade away from the vicinity of the cutting blade.

The cutting device disclosed in the Unexamined Japanese Patent Application Publication No. 2005-342854 (Claim 1, FIG. 1), is provided with a scraper formed of an elastic thin plate, which is brought in elastic contact with an upper movable blade to remove the chips depositing onto the upper movable blade.

The paper cutting device disclosed in the Unexamined Japanese Patent Application Publication Nos. 2005-271175 (Paragraph 0027, FIG. 5), is provided with a descending paper holder and ascending cutter, and with a continuous cover attached on the blade surface of the cutter tip for removing paper chips.

In the cutting device disclosed in the Unexamined Japanese Patent Application Publication No. 2005-40890 (Claim 15, FIG. 15), a paddle comes into contact with chips formed during cutting sheet bundle held vertically or obliquely from above or from the side in the vicinity of the cutting blade, and the chips are removed in the direction away from the cutting blade. In this arrangement, minute chips attached to the cutting blade cannot be removed through direct contact with the cutting blade. after cutting, the chips depositing on the cutting blade will enter the apparatus.

In the cutting device disclosed in the Unexamined Japanese Patent Application Publication No. 2005-169598 (Paragraph 0080, FIG. 11), the sheet bundle is cut out from top down. To solve the problem of cutting failure due to the chips depositing on the bundle, paddles for removing the chips are installed on both the front and rear sides in the traveling direction of the disk-shaped cutting blade, which is similar to the case of the Unexamined Japanese Patent Application Publication No. 2005-40890. However, even if it is possible to remove the large-sized chips that can be brought into contact with the paddles, small-sized chips are not brought into contact with the paddles. These chips are easy to adhere to the side surface of the cutting blade. After cutting, the chips depositing on the cutting blade will enter the apparatus.

In the cutting device disclosed in the Unexamined Japanese Patent Application Publication Nos. 2005-342854 (Claim 1, FIG. 1), a scraper formed of an elastic thin plate comes into contact with the cutting blade to remove the chips depositing on the upper movable blade and to drop them under their own weight. Chips are removed when the cutting blade cuts sheet bundle from top down and moves upward. According to this arrangement, chips having been removed by the scraper drop onto the cut sheet bundle located below and are easy to be deposited on the blade surface. Thus, these chips together with the sheet bundle will be fed into the apparatus.

In the Unexamined Japanese Patent Application Publication No. 2005-40890, No. 2005-169598, or No. 2005-342854, the method of cutting the sheet bundle up from bottom is preferably used because chips fall easily under their own weight, in contrast to the method of cutting the sheet bundle from above or from the side.

The sheet cutting device disclosed in the Unexamined Japanese Patent Application Publication No. 2005-271175 (Paragraph 0027, FIG. 5), is based on the method of cutting up from bottom, and is provided with a descending paper holder and an ascending cutter. The chips having been cut slip down the chip falling cover extending continuously to the blade surface of the cutter tip, and the chips depositing on the cutter tip cannot be removed. Thus, chips deposit on various members of the cutting device or enter the apparatus. This will cause apparatus operation failure or suspension or conveyance failure of the sheet bundle SS.

SUMMARY OF THE INVENTION

An object of the cutting device of the present invention is to avoid a possible apparatus operation failure or suspension, or conveyance failure of the sheet bundle SS, by ensuring that the chips generated by the cutting device will not remain in the vicinity of the cutting blade, not deposit on various members of the cutting device or not enter the apparatus.

Another object of the finisher of the present invention is to ensure the stable operation of the cutting device for cutting the edge portion of the sheet bundle having been bound, without stopping the device.

Still another object of the image forming apparatus of the present invention is to provide an image forming apparatus capable of ensuring a continued image forming operation and finishing operation without stopping the operation of the finisher and image forming apparatus.

The aforementioned objects of the present invention are achieved by a finisher and an image forming apparatus provided by of the present invention described below.

1. In a cutting device for cutting the edge portion of a sheet bundle in which a plurality of sheets are stacked on top of one another, using a cutting blade, the aforementioned cutting device includes: a cutting blade; a rotating paddle, arranged on the side of the aforementioned cutting blade, for removing the chips depositing on the aforementioned cutting blade by rubbing the side surface of the aforementioned cutting blade; and a controller for controlling the drive of the aforementioned paddle. The aforementioned controller includes a judging section for making a comparison between the length of the chips perpendicular to the edge of the sheets cut by the aforementioned cutting blade and a preset length; and the aforementioned controller controls the drive of the aforementioned paddle in such a way that when the aforementioned judging section has judged that the length of the aforementioned chips is smaller than the aforementioned preset length, the aforementioned paddle is rotated in a predetermined direction; and when the aforementioned judging section has judged that the length of the aforementioned chips is greater than the aforementioned preset length, the aforementioned paddle is rotated in the direction opposite the aforementioned predetermined direction.

2. In a finisher having a bookbinding section for binding a plurality of sheets by aligning the plurality of sheets, and a cutting device for cutting the edge portion of the sheet bundle having been bound by the aforementioned bookbinding section, the cutting device for cutting the edge portion of a sheet bundle in which a plurality of sheets have been stacked on top of one another, using a cutting blade, includes: a cutting blade; a rotating paddle arranged on the side of the aforementioned cutting blade, for removing the chips depositing on the aforementioned cutting blade by rubbing the side surface of the aforementioned cutting blade; and a controller for controlling the drive of the aforementioned paddle. The aforementioned controller includes a judging section for making a comparison between the length of the chips perpendicular to the edge of the sheets cut by the aforementioned cutting blade and a preset length; and the aforementioned controller controls the drive of the aforementioned paddle in such a way that when the aforementioned judging section has judged that the length of the aforementioned chips is smaller than the aforementioned preset length, the aforementioned paddle is rotated in a predetermined direction; and when the aforementioned judging section has judged that the length of the aforementioned chips is greater than the aforementioned preset length, the aforementioned paddle is rotated in the direction opposite the aforementioned predetermined direction.

3. In a bookbinding system including: an image forming apparatus having an image forming section for forming an image on a sheet; and a finisher for finishing a plurality of sheets with an image formed thereon by the aforementioned image forming section, thereby creating a sheet bundle and cutting the edge portion of the sheet bundle, the aforementioned cutting device includes a cutting blade; a rotating paddle, arranged on the side of the aforementioned cutting blade, for removing the chips depositing on the aforementioned cutting blade by rubbing the side surface the aforementioned cutting blade; and a controller for controlling the drive of the aforementioned paddle. The aforementioned controller includes a judging section for making a comparison between the length of the chips perpendicular to the edge of the sheets cut by the aforementioned cutting blade and a preset length; and the aforementioned controller controls the drive of the aforementioned paddle in such a way that when the aforementioned judging section has judged that the length of the aforementioned chips is smaller than the aforementioned preset length, the aforementioned paddle is rotated in a predetermined direction; and when the aforementioned judging section has judged that the length of the aforementioned chips is greater than the aforementioned preset length, the aforementioned paddle is rotated in the direction opposite to the aforementioned predetermined direction.

DETAILED DESCRIPTION OF THE PREFERRED EMBODIMENT

Figure 1:
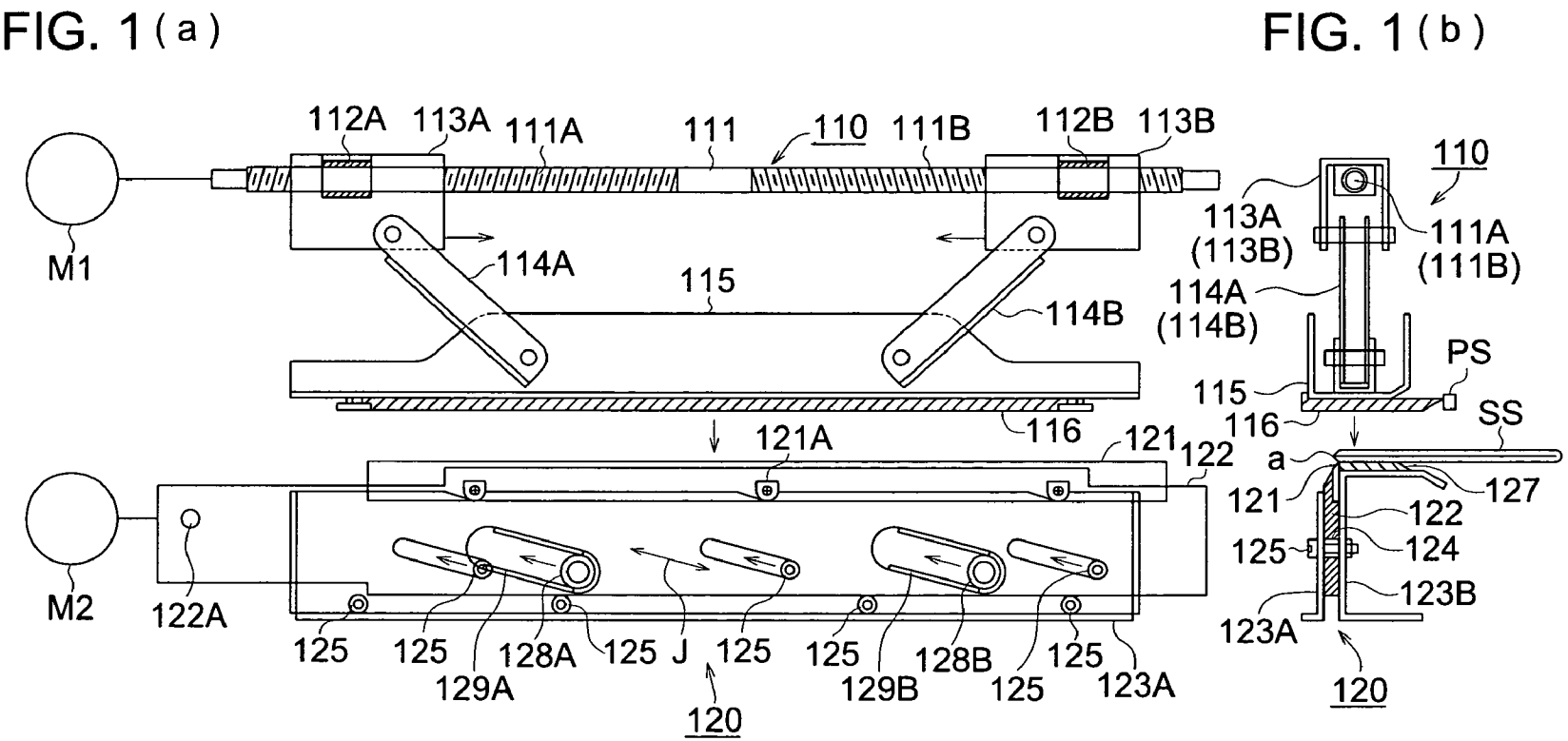
FIGS. 1(*a*) and 1(*b*) are the front view and side surface view of the major sections representing the standby state of a cutting device.

The present invention is detailed with reference to embodiments given in the drawings as follows.

[Cutting device]

FIG. 1(*a*) is a front view of the major sections representing the standby state of a cutting device 100. FIG. 1(*b*) is a side view of the major sections thereof.

A blade receiving section 110 is arranged on the upper part of the main body of the cutting device 100, and a cutting blade section 120 is mounted on the lower part of the main body.

The edge portion "a" as a tip part of the sheet bundle SS conveyed to the cutting device 100 is cut by the lowering of the blade receiving plate 116 of the blade receiving section 110 in the vertical direction, and the subsequent rising of the cutting blade 121 of the cutting blade section 120 in the oblique direction.

A rotary shaft 111 with the both ends supported is mounted on the upper part of the blade receiving section 110. The rotary shaft 111 is driven by a motor M1. The rotary shaft 111 is provided with threaded sections 111A and 111B having twist angles formed in the direction opposite each other. The threaded section 111A is meshed with a screw 112A, while the threaded section 111B is meshed with a screw 112B. The traveling member 113A and traveling member 113B perform a linear motion in the direction opposite each other in response to rotation of the rotary shaft 111.

The traveling member 113A is swingably connected with a connecting member 114A. The bottom end of the connecting member 114A is connected in a form engaged with the illustrated upper left of the pressure member 115, which is supported so as to be moved in the vertical direction. Similarly, the traveling member 113B is swingably connected with a connecting member 114B. The bottom end of the connecting member 114B is connected in a form engaged with the illustrated upper right of the pressure member 115, which is supported so as to be moved in the vertical direction.

Accordingly, the rotary shaft 111 is rotated by the drive of the motor M1, and the traveling members 113A and 113B are moved in the horizontal direction. This causes a change in the angle of inclination of the connecting members 114A and 114B, and the pressure member 115 is moved in the vertical direction.

A blade receiving plate 116 is secured on the lower surface of the pressure member 115, and is moved together with the pressure member 115 in the vertical direction. The blade receiving plate 116 is made of a resin.

The cutting blade section 120 includes a cutting blade 121, holder 122, support plates 123A and 123B, spacer member 124, fixing member 125 and support base 127.

The cutting blade 121 with a cutting edge formed on the upper top part thereof is secured on the holder 122 by a threaded member 121A. The holder 122 has a pair of support plates 123A and 123B arranged in parallel with each other and is supported movably between opposite surfaces. A spacer member 124 is interposed between the opposite surfaces of the support plates 123A and 123B. The holder 122 is held by the support plates 123A and 123B at a space that allows traveling.

The linking member 125 is led through the support plates 123A and 123B and hollow cylindrical spacer member 124, and the support plates 123A and 123B are held at a predetermined space and are tightened.

The space between the support plates 123A and 123B is set by the spacer member 124 in a wide range from 0.1 through 0.5 mm with respect to the thickness of the holder 122, whereby the holder 122 can freely travel in the vertical direction.

The linking member 125 and spacer member 124 are arranged on a plurality of positions of the support plates 123A and 123B, thereby retaining a predetermined space.

The rollers 128A and 128B are secured on the holder 122, and are guided respectively by the guide members 129A and 129B placed in downward sloping arrangement.

The drive force is applied to the pin 122A fixed on the holder 122 by the motor M2 in the lateral direction in the drawing, whereby the rollers 128A and 128 secured on the holder 122 through the pin 122A and holder 122 move along the guide members 129A and 129B obliquely in the vertical direction with reference to the direction "J" indicated by an arrow mark. As a result, the cutting blade 121 supported by the holder 122 moves up and down obliquely.

With the edge portion "a" as a leading edge, the sheet bundle SS having been fed to the cutting device 100 is conveyed on the support base 127 of the cutting blade section 120 by a conveying member (not illustrated), and is stopped at a predetermined position. At this stopped position, the sheet bundle SS is sandwiched between by the support base 127 and blade receiving plate 116 coming downward so as to be in close contact with each other. Then the edge portion "a" is cut by the cutting blade 121 an ascending thereafter.

The following describes the operation of the cutting device 100.

At the standby positions, the traveling member 113A is located at the extreme left, while the traveling member 113B lies at the extreme right. The blade receiving plate 116 is placed at the highest position, and the cutting blade 121 is at the lowest position.

When the sheet bundle SS has come to the cutting device 100, the traveling members 113A and 113B are moved by the drive of the motor M1, and the pressure member 115 is fed downward through the linking members 114A and 114B.

As the pressure member 115 is brought in close contact with the sheet bundle SS, motor 1 drive load is increased. Upon detection of an increase in drive current resulting from increase in motor 1 drive load, the controller stops the drive of the motor M1, whereby the descending of the pressure member 115 is stopped.

At the time of cutting, the pressure member 115 is pressed against the sheet bundle SS with such a great force that prevents misregistration from occurring even when a lateral force is applied by the cutting blade 121 to the sheet bundle in which a plurality of sheets stacked on top of one another.

Upon completion of pressing by the pressing of the sheet bundle SS, the motor M2 starts up to move the cutting blade 121 to the left top indicated by the arrow "J". The sheet bundle SS is cut by the traveling of the cutting blade 121. The cutting operation of the cutting blade 121 is provided by sliding of the cutter, and therefore, cutting is possible with a relatively small drive force. Furthermore, even if there are a great number of sheets to be cut, only the traveling stroke of the cutting blade 121 is changed. The drive force need not be changed.

When all the sheets of the sheet bundle SS have been cut, the tip of the cutting blade 121 comes in contact with the blade receiving plate 116 to increase the load of the driven section of the cutting blade 121. To be more specific, upon detection of an increase in drive current resulting from an increase in the load of the motor M2, the controller stops the drive of the motor M2. Thus, all the sheets of the sheet bundle SS are cut.

Upon completion of cutting of the sheet bundle SS, the motor M2 runs in the reverse direction, and the cutting blade 121 travels down to a predetermined position obliquely downward toward right in FIG. 1(*a*).

Upon completion of downward traveling of the cutting blade 121, the pressure member 115 goes up to the initial position, thereby releasing the sheet bundle SS which has been interposed and held in close contact.

The cutting operation of the edge portion of the sheet bundle SS is terminated by a series of operations discussed so far.

Figure 2:
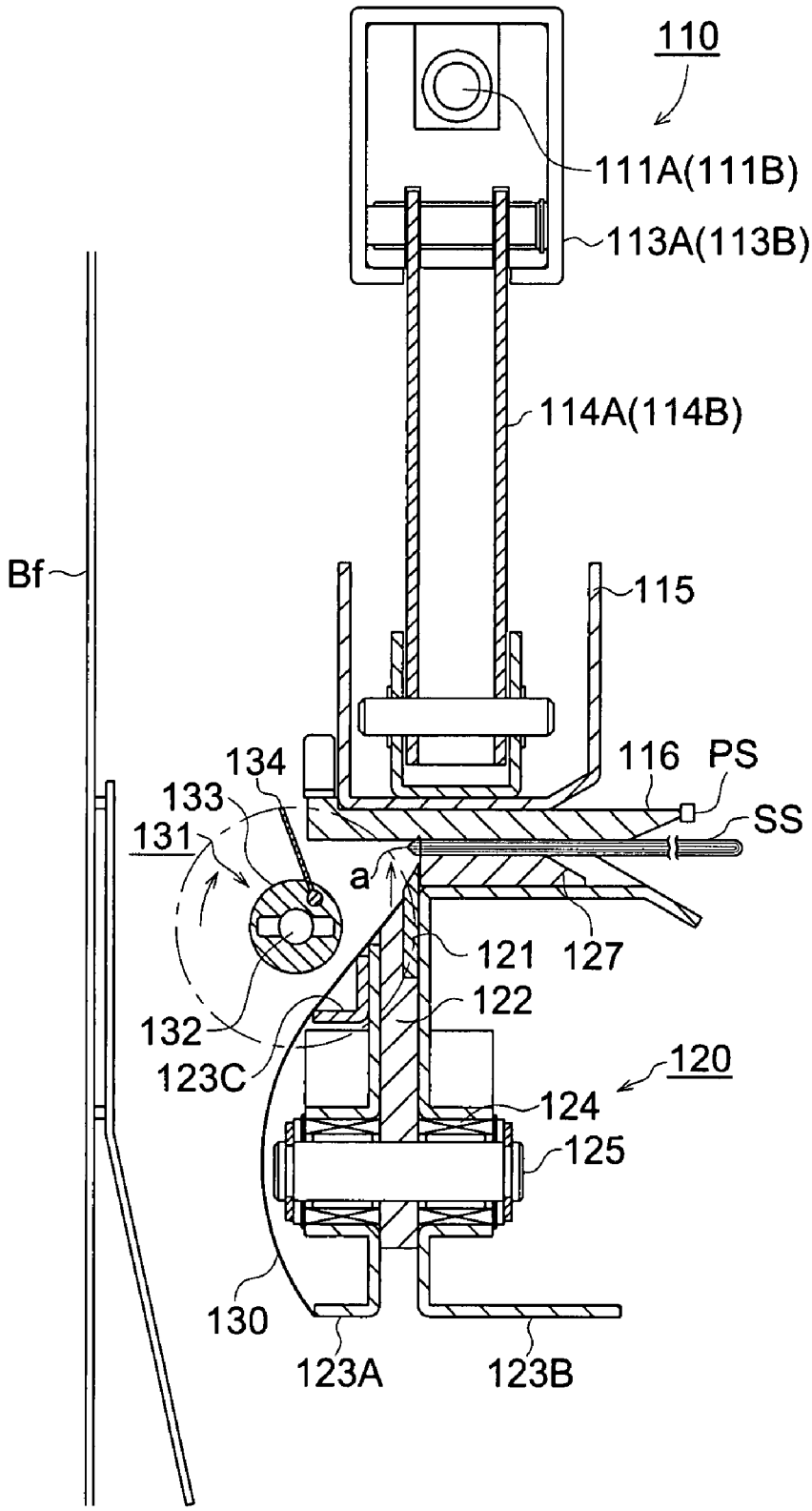
FIG. 2 is a cross sectional view of a cutting device.
Figure 3:
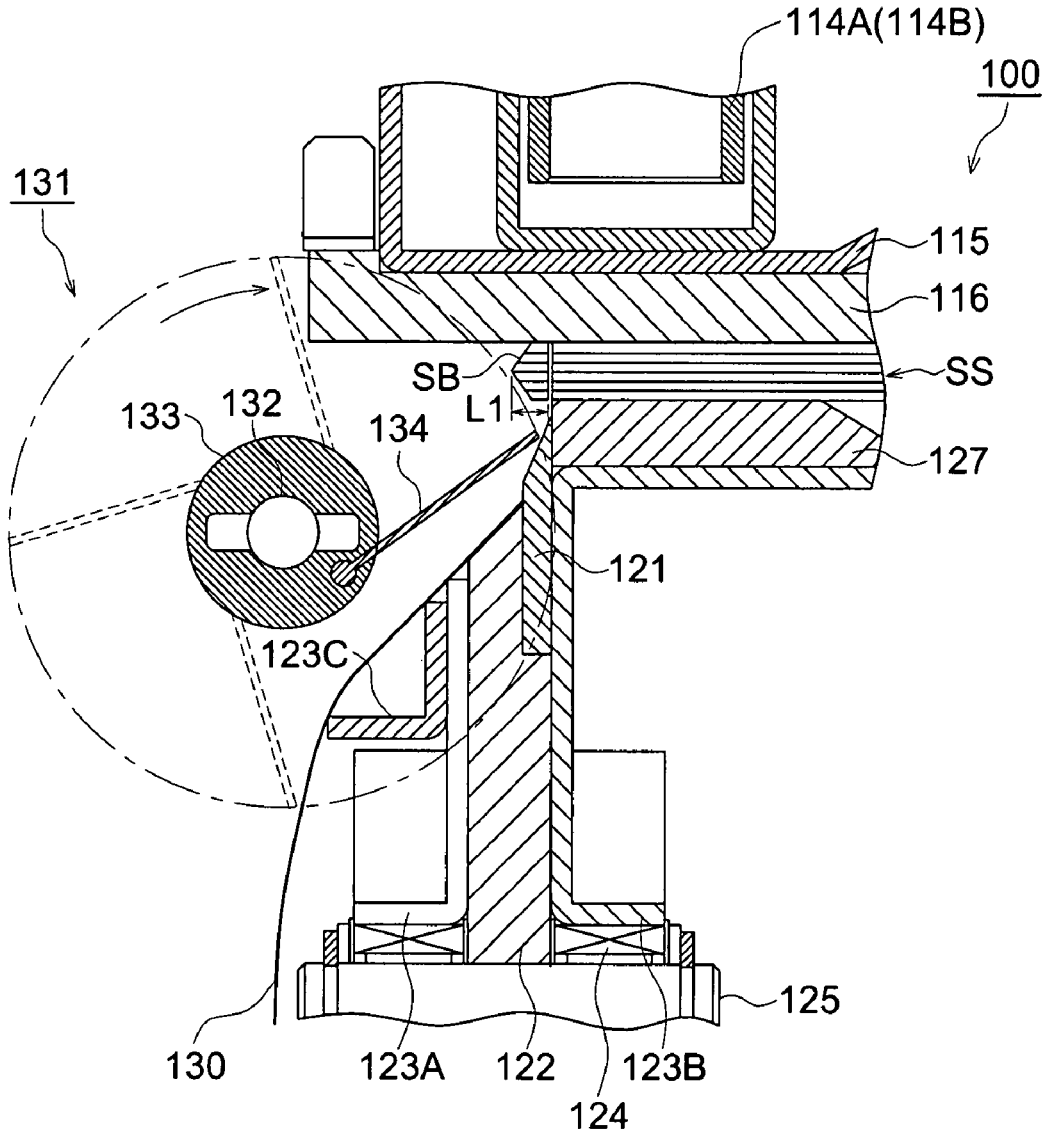
FIG. 3 is an enlarged cross sectional view of a cutting device.

FIG. 2 is a cross sectional view of the cutting device 100. FIG. 3 is an enlarged cross sectional view of the cutting device 100.

The cutting device 100 cuts the edge portion "a" which is the edge portion of the sheet bundle SS, using a cutting blade 121 arranged below the conveyance path of the sheet bundle SS and a blade receiving plate 116 located above the conveyance path. The cutting blade 121 is secured on the movable holder 122. The holder 122 is slidably supported by the support plates 123A and 123B, and can move up and down obliquely by means of the motor M2.

Based on the traveling of the holder 122 obliquely in the upward direction, the cutting blade 121 cuts the edge portion "a" of the sheet bundle SS placed on the top surface of the support base 127 and pressed against the blade receiving plate 116.

The blade receiving plate 116 is fed upward through the connecting members 114A and 114B driven by the motor M1, and is pressed against the sheet bundle SS placed on the top surface of the support base 127. At the same time, the blade receiving plate 116 comes in close contact with the tip of the cutting blade 121, whereby the edge portion "a" of the sheet bundle SS is cut.

One end of the guide member 130 guiding the chips downward is bonded onto the upper inclined plane of the holder 122 by means of a double-faced tape. The intermediate section of the guide member 130 covers the support plate 123A, L-shaped member 123C and linking member 125. Except for the cutting blade 121 that can be replaced, the guide member 130 covers the entire area on the front side Bf (left in FIG. 2) of the finisher B. Accordingly, the guide member 130 prevents the chips SB from depositing on these members. The chips SB in the sense in which this term is used here refer to small pieces of paper that is produced at the time of cutting as well as minute paper dusts.

The guide member 130 used preferably is made of the nylon, PVC, PET, polycarbonate or other resin material containing a conductive material such as carbon, metal and metallic oxide, wherein such a material is processed in a sheet. The guide member 130 made of such a material prevents depositing due to static electricity. Furthermore, the conductive guide member 130 is preferably grounded. A metallic plate such as an aluminum alloy and stainless steel can be as a conductive guide member 130, in addition to the above.

The chips SB having been cut fall down the inclined slope of the cutting blade 121 under their own weight. Then they slides down along the smooth curved surface of the guide member 130.

To tap the chips SB formed by the cutting action of the cutting blade 121 and to drop them, a paddle unit 131 having a rotating paddle 134 is arranged on the side of the cutting blade 121 in the vicinity of the cutting blade 121. The paddle unit 131 incorporates a paddle shaft 132, a plurality of holding members 133 provided in the axial direction of the paddle shaft 132, and a plurality of vane-formed paddles 134 arranged on each of the holding members 133.

Figure 4:
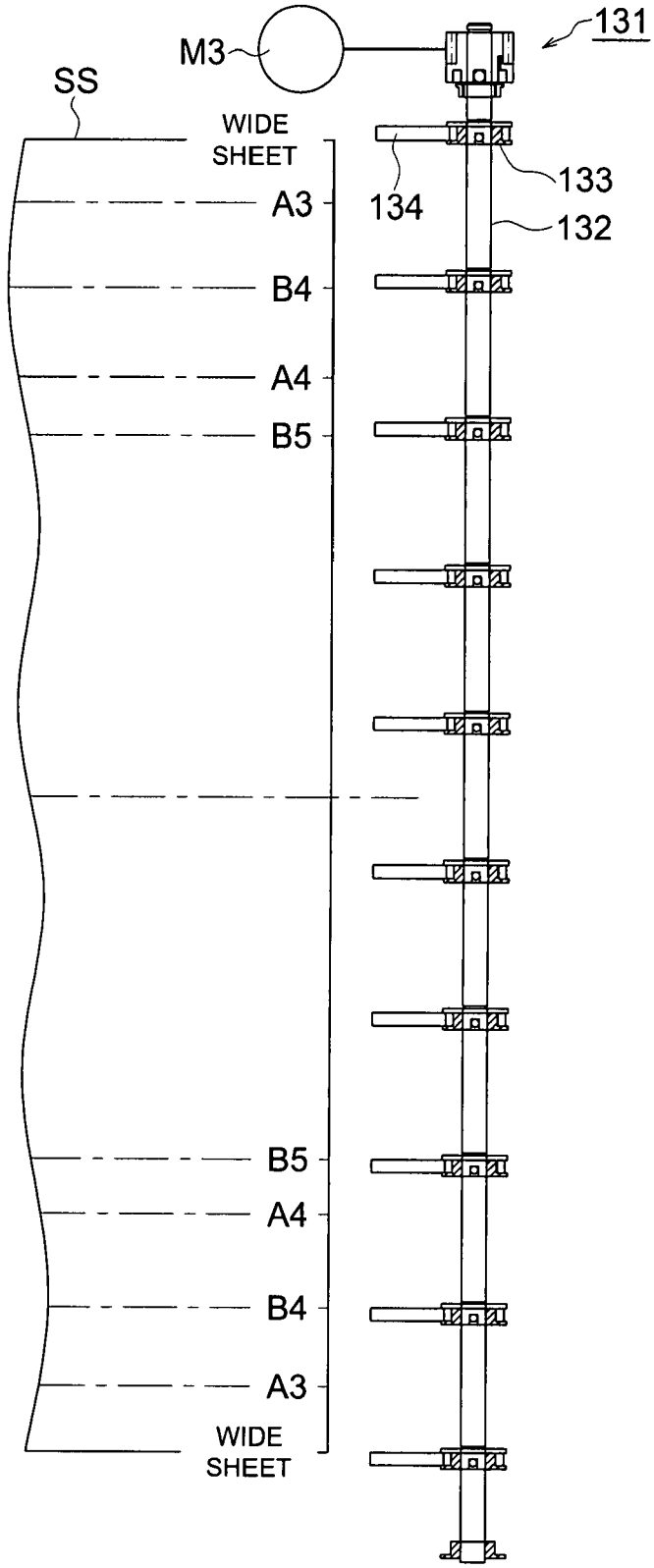
FIG. 4 is a plan view of a paddle and sheet bundles of various sizes to be cut.

FIG. 4 is a plan view of a paddle unit 131 and sheet bundles SS of various sizes to be cut.

The paddles 134 mounted on the holding member 133 are arranged at a plurality of positions (for example, 10 positions shown in the drawing) across the width perpendicular to the sheet conveying direction. A plurality of paddles 134 are arranged opposite multiple positions across the width of the edge portion "a" of the sheet bundle SS of various sizes.

The paddle shaft 132 is rotated in the forward and reverse direction by the motor M3. A plurality of holding members 133 are engaged with a plurality of positions of the paddle shaft 132. A paddle 134 is attached to each holding member 133.

The paddle 134 is a thin plate having a thickness of, for example, 1 mm formed by an elastic plate such as polyurethane plate.

In the present invention, the paddle shaft 132 is rotated in the forward and reverse directions by the motor M3. When chips SB are removed by the rotation of the paddle 134, a triangular space is created by the cutting blade 121, blade receiving plate 116 and the inclined surface on the side of the cutting blade SB. If the chips SB are smaller, chips SB are easy to adhere to the inclined surface of the cutting blade 121. Thus, the paddle 134 is rotated in the forward direction to rub the inclined surface on the side of the cutting blade SB, allowing the chips SB to fall down. If such smaller chips SB are removed by rotation of the paddle 134 in the reverse direction, small chips SB will move upward along the side surface of the cutting blade 121, and will remain in the vicinity of the tip of the cutting blade 121. When such small chips SB are kept unremoved, and the space between the cutting blade 121 and blade receiving plate 116 is released upon termination of cutting, then chips SB will enter the apparatus.

In the meantime, if the paddle 134 is rotated in the forward direction in the case of large chips SB, the chips will not be completely removed because the paddle 134 is made of an elastic member characterized by smaller effect in mechanically removing the chips. This may cause the chips to remain between the paddle 134 and cutting blade 121. Further, in the case of large chips SB, the paddle 134 will directly contact the chips SB, and the force of the paddle 134 to push into the apparatus will be applied to the chips SB. Then the chips SB will be pressed into the aforementioned triangular space wherein the force of the paddle 134 to remove chips does not work. This will create a state of compression and the chips will be trapped in the triangular space.

Thus, in the case of small chips SB, the paddle 134 is preferably rotated in the forward direction. On the other hand, in the case of large chips SB wherein the force of the paddle 134 is directly applied to the chips SB being cut off, the paddle 134 is rotated in the reverse direction so that chips SB will be pulled out of the apparatus. This arrangement prevents the chips from being trapped in the aforementioned triangular space.

With reference to drawings, the following describes the forward and reverse rotations of the paddle 134.

The paddle 134 is rotated forward in a predetermined direction by the rotation of the motor M3 in a predetermined direction, for example, by forward rotation, and is rotated in the direction indicated by the arrow, which is the predetermined direction in FIG. 3. Without coming into contact with the tip of the cutting blade 121, the tip portion of the paddle 134 contacts the position of the side surface except for the tip of the cutting blade 121. If the tip portion of the paddle 134 comes into contact with the tip of the cutting blade 121, the paddle 134 will be cut off. Thus, it is located where the tip portion of the paddle 134 does not reach the tip of the cutting blade 121.

When the tip portion of the paddle 134 rubs the side surface of the cutting blade 121 during the rotation, this force is applied to the chips SB depositing on the side surface of the cutting blade 121 after having been cut off, and the chips SB are removed by falling down.

Figure 5:
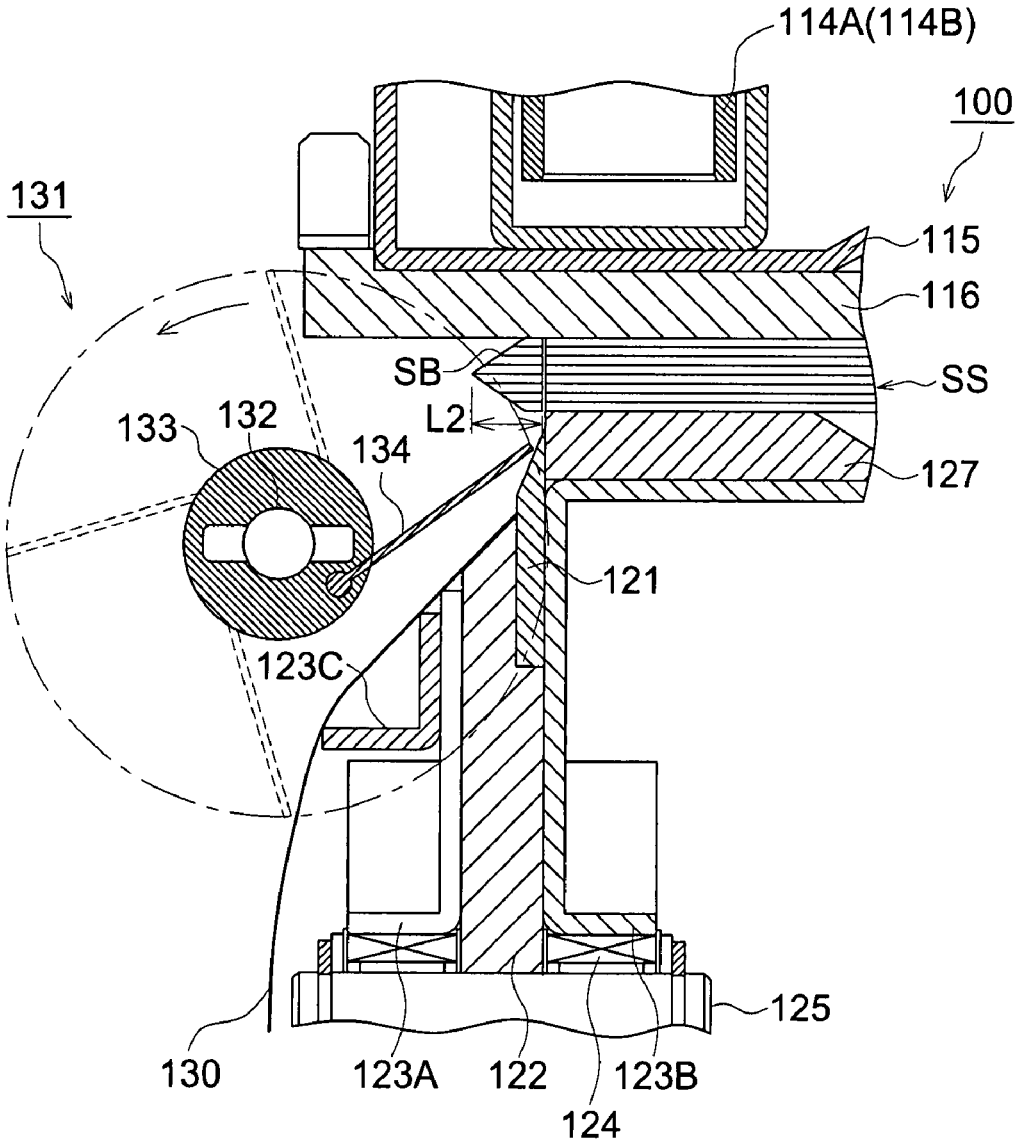
FIG. 5 is an enlarged cross sectional view showing a cutting device 100 when a paddle 134 is rotated in the reverse direction by a motor M3.
Figure 6:
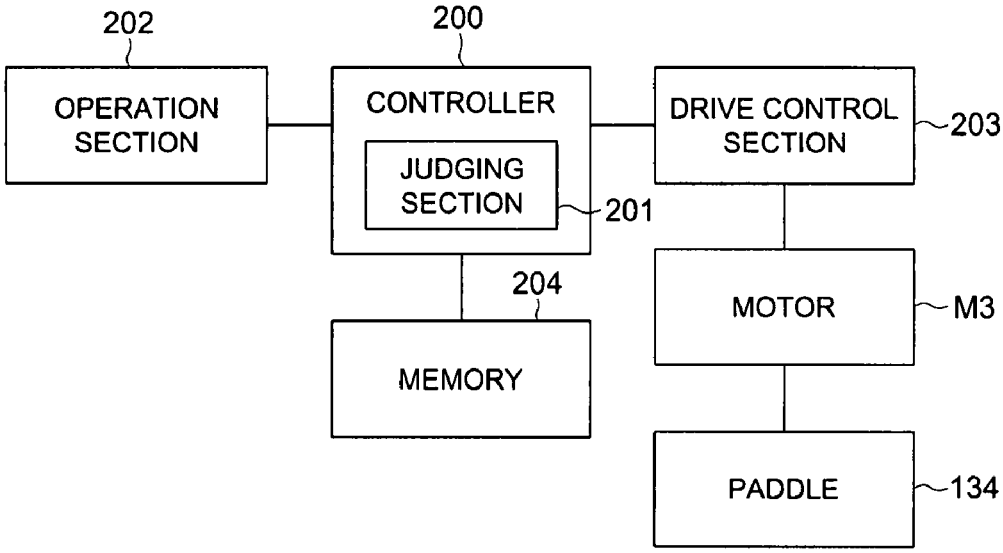
FIG. 6 is a block diagram representing the control of the forward/reverse rotation of the paddle.
Figure 7:
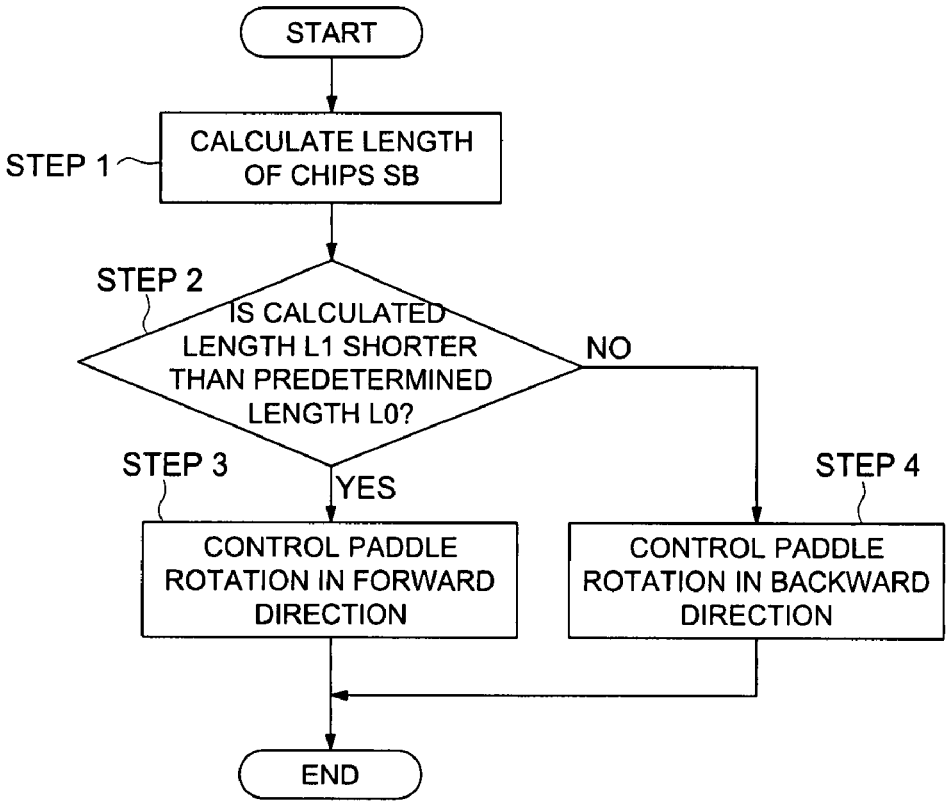
FIG. 7 is a flowchart representing the control of the forward/reverse rotation of the paddle.

FIG. 5 is an enlarged cross sectional view showing a cutting device 100 when a paddle 134 is rotated in the reverse direction by a motor M3. FIG. 6 is a block diagram representing the control of the forward and reverse rotation of the paddle 134. FIG. 7 is a flowchart representing the control of the forward and reverse rotation of the paddle.

The length and size of the sheet in the sheet bundle to be cut by the cutting blade 121 are set in advance by inputting such information from the operation section 202. Based on the information on the length and size of the sheets in the sheet bundle, the controller 200 calculates the cut length (L1) of the chips SB in the sheet bundle SS to be cut by the cutting blade 121 (Step 1). The calculated length (L1) of the chips SB is compared with a predetermined length (L0) preset in the memory 204 to determine if it is short or not (Step 2). The result of Step 2 determines the rotating direction of the paddle. This information is reported to the drive control section 203 of the cutting device. Based on the information of the rotating direction, the drive control section 203 of the cutting device provides control in such a way that the motor M3 that drives the paddle is driven in the reported direction of rotation.

The length (L1) of the chips SB cut off from the sheet bundle SS by the cutting blade 121 is compared with a predetermined length (L0) preset on the memory 204, for example, 15 mm by the judging section 201 of the controller 200. If the result of this comparison and decision reveals that the length (L1) of the chips SB is smaller than the predetermined length (L0) (Yes in Step 2), then the controller 200 allows the paddle 134 to rotate in the forward direction (Step 3), as indicated by the arrow of FIG. 3. The forward rotation of the paddle 134 allows the chips SB to fall down the side surface of the cutting blade 121 and the guide member from the space between the cutting blade 121 and paddle 134. These chips are collected in a chip container.

When the judging section 201 has judged that the length (L1) of the chips SB is greater than the predetermined length (L0) (No in Step 2), then the controller 200 switches the control mode in such a way that the paddle 134 will rotate in the reverse direction (Step 4), as indicated by the arrow of FIG. 5. By the paddle 134 rotating in the reverse direction, the chips SB are carried to the wide space on the side of the aforementioned paddle 134 opposite to the aforementioned cutting blade 121 with respect to a rotary axis of the paddle. Then the chips are allowed to fall down.

As described above, the length (L1) of the chips SB can be calculated based on the cut length and size of the sheets in the sheet bundle to be cut, wherein the length and size have been inputted by the user through the operation section 202. The length (L1) of the chips SB can also be detected by another method. For example, as shown in FIG. 2, a sensor PS for detecting the tip of the sheet bundle is arranged at the inlet of the cutting device. The traveling distance is found out according to the time duration from the detection of the tip of the sheet bundle to the stop. The distance between the cutting position and sensor PS is subtracted from the traveling distance, whereby the length (L1) of chips SB can be calculated. In this case, the stop of the sheet bundle is controlled in response to the information on the amount of cutting inputted by the user through the operation section 202.

When paddles 134 are is arranged at a plurality of positions in the axial direction of the paddle shaft 132, chips SB can be removed by scraping in response to the size of the sheet such as wide-, A3-, B4-, A4- or B5-sized sheet.

Figure 8:
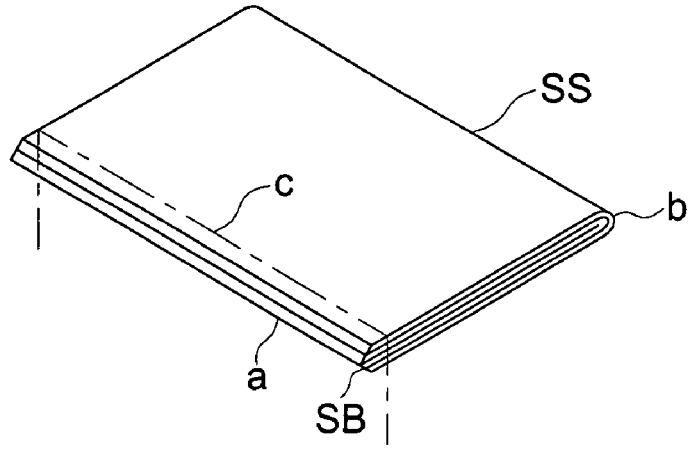
FIGS. 8(*a*) through 8(*d*) are perspective view and cross sectional view of sheet bundles of various types having been finished.
Figure 8:
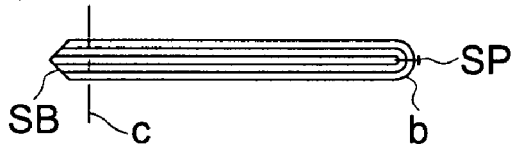
Figure 8:
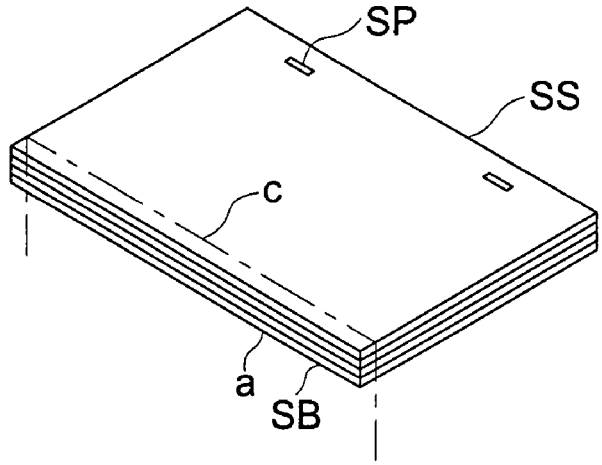
Figure 8:
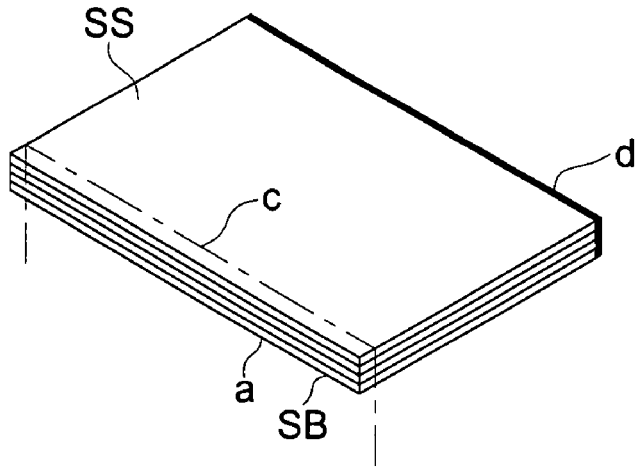

FIGS. 8(*a*) through 8(*d*) are perspective view and cross sectional view of sheet bundles of various types having been finished. FIG. 8(*a*) is a perspective view representing the sheet bundle SS having been center-folded and center-bound. FIG. 8(*b*) is a cross sectional view of the sheet bundle SS. FIG. 8(*c*) is a perspective view showing the sheet bundle SS having been side-bound. FIG. 8(*d*) is a perspective view showing the sheet bundle SS having been glued. In these drawings, "a" shows the edge portion, "b" the fold portion, "c" the cutting line, and "SP" the wire staple, and "d" the bonded portion.

[Finisher Provided with a Cutting Device and Image Forming Apparatus]

The finisher B of the present invention denotes a finisher provided with a cutting device 100, and the image forming apparatus refers to the image forming apparatus wherein a finisher incorporating a cutting device is connected integrally with the image forming apparatus main body A of FIGS. 8(*a*) through 8(*d*). The finisher incorporating the cutting device of the present invention can be designed so that it can be used independently. It is to be understood that the finisher of the present invention and the image forming apparatus provided with the finisher are restricted to the following embodiments.

[Image Forming Apparatus Main Body]

Figure 9:
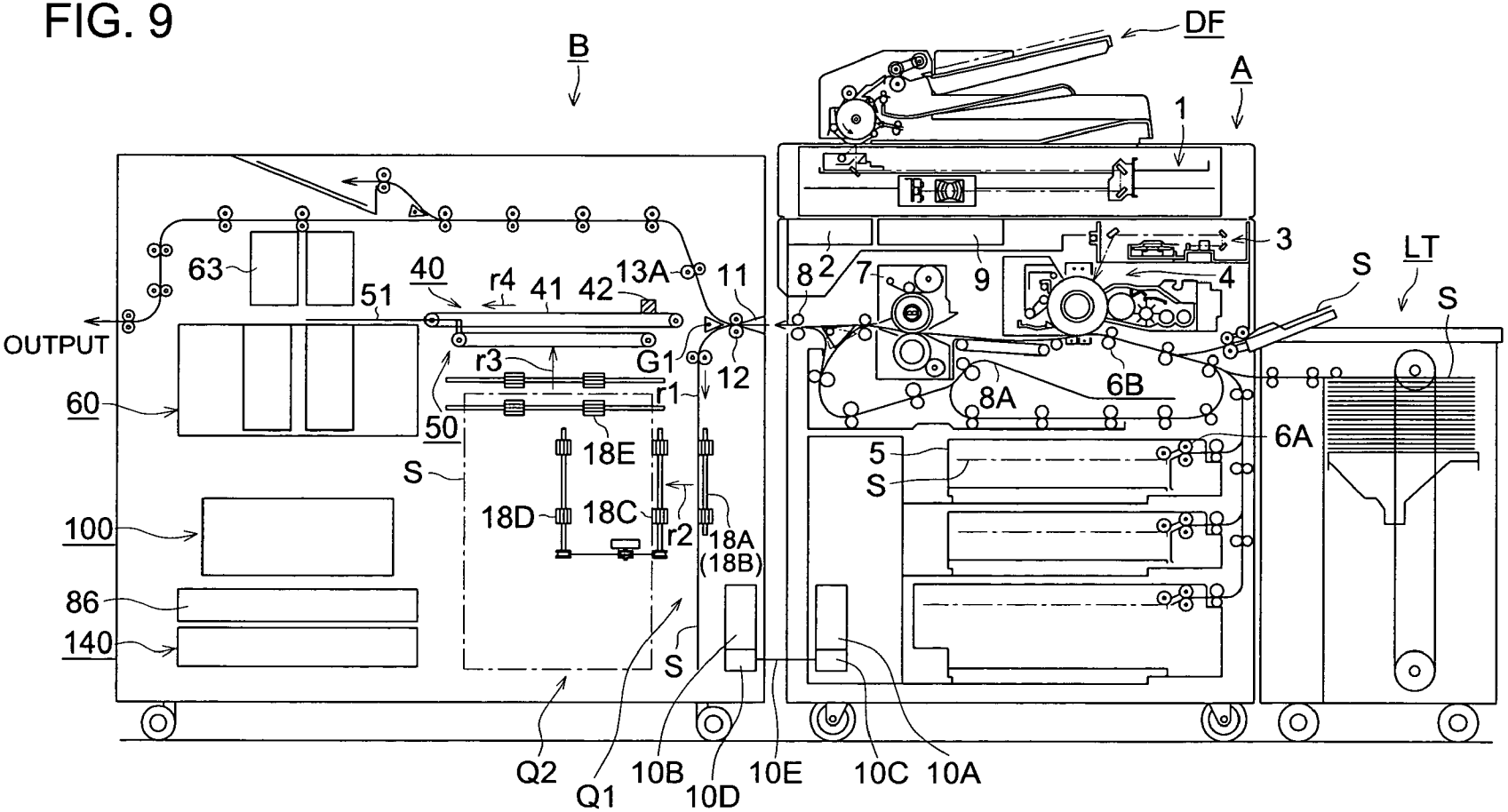
FIG. 9 is an overall schematic diagram showing an image forming apparatus incorporating a finisher and an image forming apparatus main body.

FIG. 9 is an overall schematic diagram showing an image forming apparatus incorporating a finisher B containing a cutting device 100 and an image forming apparatus main body A.

The image forming apparatus is composed of an image forming apparatus main body A, automatic document feeder DF, finisher B and large capacity sheet feeding apparatus LT.

The illustrated image forming apparatus main body A contains an image reading section 1, image processing section 2, image writing section 3, image forming section 4, sheet feed tray 5, first sheet feed section 6A, second sheet feed section 6B, fixing apparatus 7, sheet ejection section 8, and automatic duplex unit (ADU) 8A.

A finisher B containing a cutting device 100 is connected to the side of the sheet ejection section 8 on the illustrated left side surface of the image forming apparatus main body A.

The operation section 9 selects and sets the processing function of the image forming apparatus including an image forming apparatus main body A, finisher B and others.

The main control section 10A of the image forming apparatus main body A is connected to the finishing controller 10B of the finisher B through communications sections 10C and 10D, and communications line 10E.

[Finisher]

Figure 10:
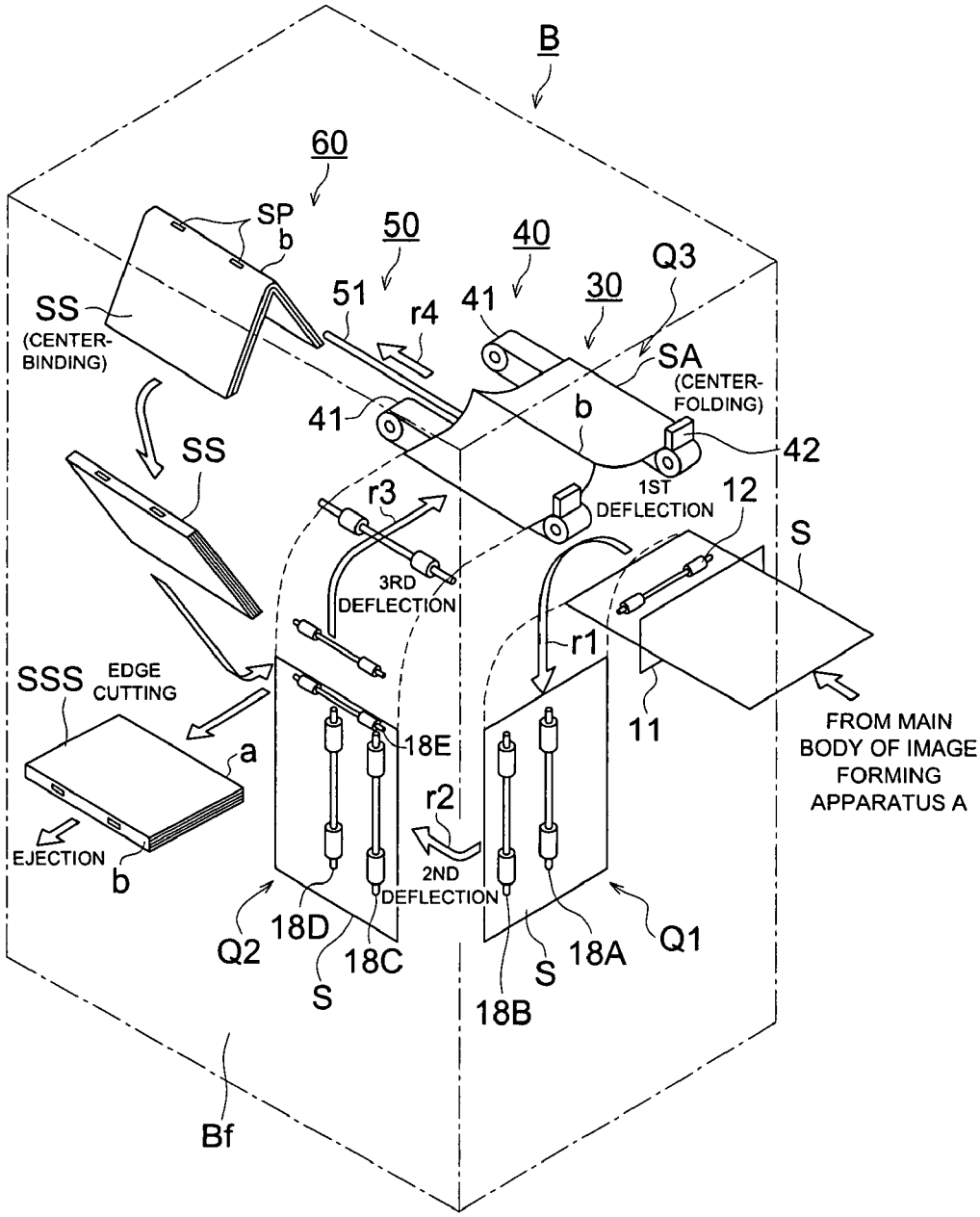
FIG. 10 is a schematic diagram representing how sheets are conveyed in the processes of center folding and center binding in the finisher.

FIG. 10 is a schematic diagram representing how sheets are conveyed in the processes of center folding and center binding in the finisher B.

Figure 11:
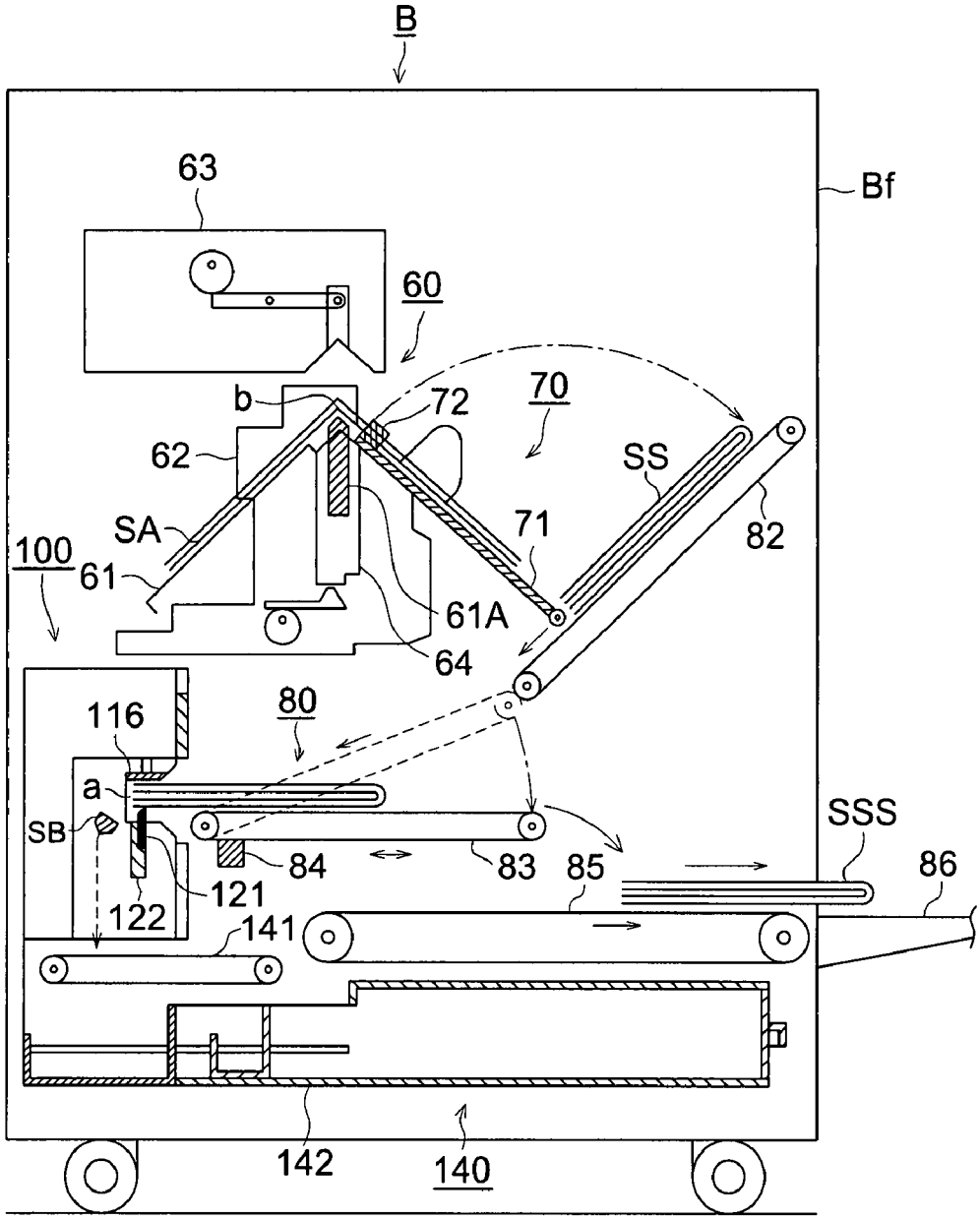
FIG. 11 is a left side elevation view of the finisher.

When the process of the center folding and center binding in bookbinding is programmed in the operation section 9 as shown in FIGS. 10 and 11, the sheets S ejected from the image forming apparatus main body A are led to the inlet section 11 of the finisher B, are sandwiched between the inlet rollers 12, and are conveyed to the sheet conveyance path r1 below the conveyance path switching member G1.

The sheets S conveyed to the sheet conveyance path 1 below the conveyance path switching member G1 are fed downward approximately in the vertical direction and then stop temporarily at a predetermined position to be stored. At this first stop position Q1, a plurality of the succeeding sheets S are placed one on top of another and are stored.

The stored sheets S are conveyed in the perpendicular direction by a pair of conveyance rollers 18A and 18B, a pair of first conveyance rollers 18C and 18D, and the guide plate (not illustrated) after the direction has been changed. The sheets are conveyed along the sheet conveyance path r2 leading to the front side Bf inside the finisher B, with the sheet surface in the upright position, and are stopped temporarily at the second stop position Q2.

The sheets S are conveyed in the vertical direction by a pair of second conveyance rollers 18E and are conveyed in the horizontal direction after the direction has been changed. After that, they are conveyed along sheet conveyance path r3.

The sheet tip portion is positioned by engagement with the aligning section arranged on the downstream side in sheet conveying direction of the sheet conveyance path r3. After having been aligned, the sheets are stopped temporarily at the third stop position Q3.

A center folding section 30 is arranged on the downstream side in the sheet conveying direction of the aligning section. The center folding section 30 is composed of a folding roller, folding plate and others, and performs center-folding processing.

After having been folded in two by the center folding section 30, the folded sheets SA with a fold "b" formed thereon is fed back to the original horizontal sheet conveyance path. The folded sheets SA is fed to the sheet conveyance path r4 on the extension of the fold "b" by the conveying belt 41 of the conveying section 40, conveyance claw 42 and introduction guide member 51 of the folded sheets guiding section 50, and is then fed to the center-binding section 60.

As described above, the center folding section 30 applies a process of center-folding to one through three sheets of a small number of sheets S to create a rigid fold "b" thereon. These sheets are sequentially fed to the center-binding section 60, thereby producing the sheet bundle SS containing a smaller bulge in the fold "b".

The folded sheets SA subjected to the process of center-folding processing by the center folding section 30 is conveyed toward the sheet conveyance path r4 by the conveying section 40, and is placed on the saddle-shaped stacking section 61 of the center-binding section 60 shown in FIG. 3. The succeeding folded sheets SA subjected to the process of center-folding are also conveyed along the sheet conveyance path r4, and are stacked on the saddle-shaped stacking section 61.

The saddle-shaped stacking section 61 is made of two guide plates approximately perpendicular to each other, and is secured on the main body of the finisher B. In the vicinity of the top of the saddle-shaped stacking section 61, a pressure member 61A which is spring-urged for vertical traveling is arranged in a form supported by the staple receiving mechanism 64.

The top of the pressure member 61A is formed in a concave having approximate right angles on the top, and the fold "b" of the folded sheets SA subjected to the process of center-folding is placed on the edge line of the top.

A plurality of folded sheets SA placed on the saddle-shaped stacking section 61 and pressure member 61A are position-adjusted by a width aligning member 62.

The stapling mechanism 63 is arranged fixedly above the pressure member 61A. Inside the saddle-shaped stacking section 61, the pressure member 61A and staple receiving mechanism 64 are supported movably in the vertical direction.

Two sets of the two-split structure binding sections composed of a stapling mechanism 63 and staple receiving mechanism 64 are arranged in the direction of the sheet fold. When the process of center-binding is programmed on the operation section, the staple receiving mechanism 64 goes upward, and performs the process of center-binding. To be more specific, two sets of binding sections drive a wire staple SP at two positions in a form separated at center into two parts, along the fold "b" of the folded sheets SA on the pressure member 61A.

The sheet bundle SS subjected to the process of center-binding by the center-binding section 60 is held by the support member 72 secured on the tip portion of the arm member 71 of the pickup section 70. The sheet bundle SS is rocked by the arm member 71 in the direction shown by a one-dot chain line arrow, and is conveyed to the conveying section 80.

The sheet bundle SS fed by the conveying section 80 is placed on the conveying belt 82. The sheet bundle SS is fed obliquely in the downward direction by the rotation of the conveying belt 82. It is then held in the inclined position, and is conveyed by the rotating conveying belt 83 to stop at a predetermined position. After that, the conveying belt 83 is rocked and is supported in the horizontal position.

The edge portion "a" as the edge portion opposite the fold "b" of the sheet bundle SS placed on the conveying belt 83 in the horizontal position is uneven due to the number of the sheets of the sheet bundle SS, and therefore, the edge portion "a" is trimmed and made uniform by cutting with a cutting blade 121 and blade receiving plate 116 of the cutting device 100 of the present invention.

The booklet SSS created by cutting is placed on the conveying belt 83 rotating in the reverse direction, and is conveyed by an aligning member 84 secured on the conveying belt 83, the trailing edge of the booklet SSS being pressed. The booklet SSS then falls down in the direction indicated by the arrow from the tip portion of the conveying belt 83. The booklet SSS having fallen is ejected to the ejection tray 86 arranged outside the front side Bf of the finisher B by the rotating ejection belt 85.

A chip processing section 140 is installed below the conveying section 80 and cutting device 100. The chips SB with the edge portion "a" being cut off by the cutting blade 121 and the blade receiving plate 116 of the cutting device 100 fall on the rotating chips conveying belt 141 and are conveyed to be stored in the chips container 142.

The embodiment of the present invention has been described with reference to the cutting device 100 of the finisher B containing a center folding and center binding function connected to the main body of the image forming apparatus. The present invention is applicable to the cutting device of the finisher that performs center-folding processing after center-binding processing. The present invention is also applicable to the bookbinding apparatus wherein gluing or the like is provided by a finisher.

The finisher equipped with the cutting device of the present invention can be connected with a bookbinding apparatus connected to a light type printing machine, thereby ensuring a consistent multi-purpose and multi-function process of finishing.

The present invention is also applicable to the finisher connected to a photocopier, printer, facsimile, multifunction machine and others. This will provide the similar advantages.

In the aforementioned embodiment, electrophotographic technology has been mentioned as an example of recording method. Without being restricted thereto, the present invention is applicable to other recording methods such as an inkjet method.

Further, the finisher of the present invention can be used as the stand-alone finisher separated from the image forming apparatus, thereby providing various forms of folding, binding and cutting.

The cutting device, finisher and image forming apparatus of the present invention provide the aforementioned advantages.

1. The present invention eliminates the possibility that the chips generated by the cutting device for cutting the edge portion of the sheet bundle having been conveyed, remain in the vicinity of the cutting blade, and enter the apparatus to cause a trouble.

2. In a finisher for aligning a plurality of sheets and bookbinding after finishing such as center-folding processing and center-binding processing, of the present invention ensures the trouble-free, reliable and stable operation of a cutting device for cutting the edge portion of the sheet bundle bound in a form of a book.

3. The present invention provides a bookbinding system provides the stable operation of the cutting device and ensures continuous and efficient processing of image forming and finishing without stopping the bookbinding system.

What is claimed is:

1. A cutting device that cuts an edge portion of a sheet bundle in which a plurality of sheets are stacked, the cutting device comprising:

(a) a cutting blade which cuts the edge portion of the sheet bundle;

(b) a paddle provided on a side of the cutting blade, which removes chips attached to the cutting blade by rubbing a side surface of the cutting blade; and (c) a controller which controls drive of the paddle, wherein the controller comprises a judging section which compares a length of the chips in a direction perpendicular to an edge side of the sheet bundle to be cut by the cutting blade with a predetermined length that has been preset, and wherein when the judging section judges that the length of the chips is shorter than the predetermined length, the controller controls the paddle to rotate in a predetermined direction, and when the judging section judges that the length of the chips is longer than the predetermined length, the controller controls the paddle to rotate in a direction opposite to the predetermined direction.

2. The cutting device of claim 1, wherein the chips are fallen downward along the side surface of the cutting blade from a first space between the cutting blade and the paddle toward a downward second space by the rotation of the paddle in the predetermined direction, and the chips are conveyed to a third space on a side of the paddle opposite to the cutting blade with respect to a rotary axis of the paddle, and then fallen downward from the third space by the rotation of the paddle in a direction opposite to the predetermined direction.

3. The cutting device of claim 1, wherein the cutting blade cuts the sheet bundle upward by being moved obliquely upward.

4. The cutting device of claim 1, wherein the paddle is formed by an elastic plate.

5. A finisher comprising:

(a) a bookbinding processing section which aligns a plurality of sheets and binds the sheets; and (b) a cutting device which cuts en edge portion of a sheet bundle that has been bound by the bookbinding processing section, the cutting device comprising:

(1) a cutting blade which cuts the edge portion of the sheet bundle;

(2) a paddle provided on a side of the cutting blade, which removes chips attached to the cutting blade by rubbing a side surface of the cutting blade; and (3) a controller which controls drive of the paddle, wherein the controller comprises a judging section which compares a length of the chips in a direction perpendicular to an edge side of the sheet bundle to be cut by the cutting blade with a predetermined length that has been preset, and wherein when the judging section judges that the length of the chips is shorter than the predetermined length, the controller controls the paddle to rotate in a predetermined direction, and when the judging section judges that the length of the chips is longer than the predetermined length, the controller controls the paddle to rotate in a direction opposite to the predetermined direction.

6. The finisher of claim 5, wherein the chips are fallen downward along the side surface of the cutting blade from a first space between the cutting blade and the paddle toward a downward second space by the rotation of the paddle in the predetermined direction, and the chips are conveyed to a third space on a side of the paddle opposite to the cutting blade with respect to a rotary axis of the paddle, and then fallen downward for the third space by the rotation of the paddle in a direction opposite to the predetermined direction.

7. The cutting device of claim 5, wherein the cutting blade cuts the sheet bundle upward by being moved obliquely upward.

8. The cutting device of claim 5, wherein the paddle is formed by an elastic plate.

9. The cutting device of claim 5, wherein the cutting device cuts an edge portion of a sheet bundle in which the plurality of sheets have been center-folded and center-bound, thereby a book is formed.

10. A book binding system comprising:

(a) an image forming apparatus having an image forming section that forms an image on a sheet;

(b) a finisher finishes a plurality of sheets each on which the image has been formed by the image forming apparatus to form a sheet bundle, an edge portion of which is cut by a cutting device to form a book, the cutting device comprising:

(1) a cutting blade which cuts the edge portion of the sheet bundle;

(2) a paddle provided on a side of the cutting blade, which removes chips attached to the cutting blade by rubbing a side surface of the cutting blade; and (3) a controller which controls drive of the paddle;

wherein the controller comprises a judging section which compares a length of the chips in a direction perpendicular to an edge side of the sheet bundle to be cut by the cutting blade with a predetermined length that has been preset, and wherein when the judging section judges that the length of the chips is shorter than the predetermined length, the controller controls the paddle to rotate in a predetermined direction, and when the judging section judges that the length of the chips is longer than the predetermined length, the controller controls the paddle to rotate in a direction opposite to the predetermined direction.

11. The bookbinding system of claim 10, wherein the chips are fallen downward along the side surface of the cutting blade from a first space between the cutting blade and the paddle toward a downward second space by the rotation of the paddle in the predetermined direction, and the chips are conveyed to a third space on a side of the paddle opposite to the cutting blade with respect to a rotary axis of the paddle, and then fallen downward for the third space by the rotation of the paddle in a direction opposite to the predetermined direction.

12. The cutting device of claim 10, wherein the cutting blade cuts the sheet bundle upward by being moved obliquely upward.

13. The cutting device of claim 10, wherein the paddle is formed by an elastic plate.

* * * * *